US008708126B2

(12) United States Patent
Paczkowski

(10) Patent No.: US 8,708,126 B2
(45) Date of Patent: Apr. 29, 2014

(54) BILL VALIDATOR—DISPENSER WITH IMPROVED SECURITY

(75) Inventor: Thomas S. Paczkowski, Grover, MO (US)

(73) Assignee: Coin Acceptors, Inc., St. Louis, MO (US)

( * ) Notice: Subject to any disclaimer, the term of this patent is extended or adjusted under 35 U.S.C. 154(b) by 0 days.

(21) Appl. No.: 12/435,242

(22) Filed: May 4, 2009

(65) Prior Publication Data

US 2009/0294245 A1 Dec. 3, 2009

Related U.S. Application Data

(60) Provisional application No. 61/050,079, filed on May 2, 2008.

(51) Int. Cl.
*G07F 7/04* (2006.01)

(52) U.S. Cl.
USPC ..... 194/206

(58) Field of Classification Search
USPC ..... 194/206, 200, 207, 342, 343, 350, 344, 194/346, 349; 209/534; 235/379; 206/499, 206/503, 504; 271/213, 214, 215, 217
See application file for complete search history.

(56) References Cited

U.S. PATENT DOCUMENTS 5,421,443 A * 6/1995 Hatamachi et al. ..... 194/206

* cited by examiner

*Primary Examiner* — Mark Beauchaine
(74) *Attorney, Agent, or Firm* — Polster Lieder

(57) ABSTRACT

A method is shown providing a Bill Validator that is adaptable for bill payback by utilizing an attachable bill hopper module to fit between the bill Stacker and the Bill Validator.

A construction is shown providing a bill Validator utilizing an attachable bill hopper module fitted between the bill Stacker and the bill Validator that fits in the same "envelope" with an existing Bill Validator with Stacker.

A method and construction is shown where higher bill security is provided when the power is off.

A method and construction is shown where higher bill security is provided when humidity and icing occur in and around the inlet.

2 Claims, 8 Drawing Sheets

BILL VALIDATOR—DISPENSER WITH IMPROVED SECURITY

CROSS-REFERENCE TO RELATED APPLICATIONS

This application claims priority from U.S. provisional application 61/050,079 filed May 2, 2008, and that application incorporates by reference PCT Patent Application No. PCT/US2007/022476 filed Oct. 22, 2007, and U.S. Provisional Patent Application No. 60/862,346, filed Oct. 20, 2006, all of which are incorporated herein by reference.

BACKGROUND OF THE INVENTION

A bill receiving and payout device used for a vending machine or a money exchanger consists generally of a bill discrimination device for discriminating whether a deposited bill is a true bill or a false one including the denomination thereof and a bill receiving device for receiving a bill which has been accepted as a true bill by the bill discrimination device. Known in the art are various bill receiving devices.

A bill receiving device capable of paying out a once received bill per se is known. Also known is a bill receiving device capable of stacking bills of two different denominations separately.

Our patent application "Method of Receiving and Payout Bills" USA Application #60/862,346 describes a bill receiving device for storing bills into a stacker or into a dispenser stacker also know as a bill hopper. Bills form the bill hopper could be dispensed to the customer using the same inlet as the one used to accept the bill.

Other bill payout disclosures include the following list of U.S. Patent Numbers:

U.S. Pat. Nos. 5,205,481; 5,209,335; 5,209,395; 5,495,929; 5,564,545; 5,653,436; 5,657,846; 5,715,923; 5,730,271; 5,730,271; 5,803,227; 5,836,510; 5,887,695; 5,907,141; 5,964,462; 6,019,208; 6,047,886; 6,057,683; 6,105,747; 6,142,284; 6,149,150; 6,163,034; 6,164,642; 6,186,339; 6,229,317; 6,241,240; 6,289,261; 6,293,867; 6,296,242; 6,332,099; 6,371,473; 6,379,246; 6,567,722; 6,598,788; 6,619,461; 6,651,796; 6,712,352; 6,722,781; 6,742,644; 6,742,645; 6,745,887; 6,827,235; 6,860,480; 6,889,849; 6,889,850; 6,907,977; 6,957,732; 6,959,859; 7,100,913, U.S. Patent Publications 2004/0012142; 2004/0050651; 2004/0129529; 2004/0130318; 2004/0206601; 2004/0249501; 2005/0284728 and, Foreign Patent Number WO 0243013.

Vandalism has long been a problem for vending machines equipped with a Bill Validator. Sometimes thieves may pry open the vending machine bottom of the door to gain access to a change box. Similarly, thieves may pry open the top of the door to gain access to bills in a dollar bill Validator.

More recently vandals attack the bill Validator directly through its inlet "phishing" the bills from the stackers especially when the Vending Machine A.C. power is OFF and so any alarms are eliminated.

BRIEF SUMMARY OF THE INVENTION

It is, therefore, an object of the present invention to provide a bill receiving device capable of dividing bills into two kinds, and separately storing the divided bills and paying out at least one specific denomination using a very simple and compact construction.

For achieving the above described object, the bill receiving device according to the invention is characterized in that it comprises a bill passage in about the central portion of an elongate casing that extends in a first direction along one side of a first bill receiving chamber having a bill payback outlet, and redirected around and extending in an opposite second direction along the second side of said first bill receiving chamber, provides a second bill receiving chamber extending along the outer side of the said passage second direction and across from and aligned with the said first bill receiving chamber, provides a bill conveying apparatus for conveying a bill delivered to said bill passage first or second directions to a predetermined position for receiving it, utilizes a bill pushing member for moving in a reciprocating motion across said passage first direction to said first bill receiving chamber when the bill is located at a predetermined position in said passage first direction to be received, effects receiving of the bill when pushing it with a surface of said bill pushing member across from said passage first direction, receives a bill in said second bill receiving chamber that is in a predetermined position in said passage second direction by pushing it with an extendable surface from said first bill receiving chamber by activating the said bill pushing member across from said passage first direction, and, activates a bill conveying member for moving the rearmost bill from said first bill receiving chamber through its said bill payback outlet to the said bill conveying apparatus operated in reverse to direct the said rearmost bill for paying back to the customer.

It is a further object of this invention to provide very reliable method for extracting a bill for payout by extraction, and determination of extraction of the rearmost bill out from a bill stack using an upper edge retainer/deflector and a rubber cam roller operating in a first direction, and then in a second direction.

There is another object of this invention to provide a bill receiving device capable to better protect the content of the two stacker boxes.

It is a further object of this invention to provide an improved method of protecting the bills in the stackers against thieves even when the power to the unit is off.

It is a further object of this invention to provide a higher security for bills while maintaining high bill acceptability rates even in hard weather conditions when humidity or icing occurs in the inlet.

BRIEF DESCRIPTION OF THE DRAWINGS

In the accompanying drawings.

DESCRIPTION OF PREFERRED EMBODIMENTS

Figure 1:
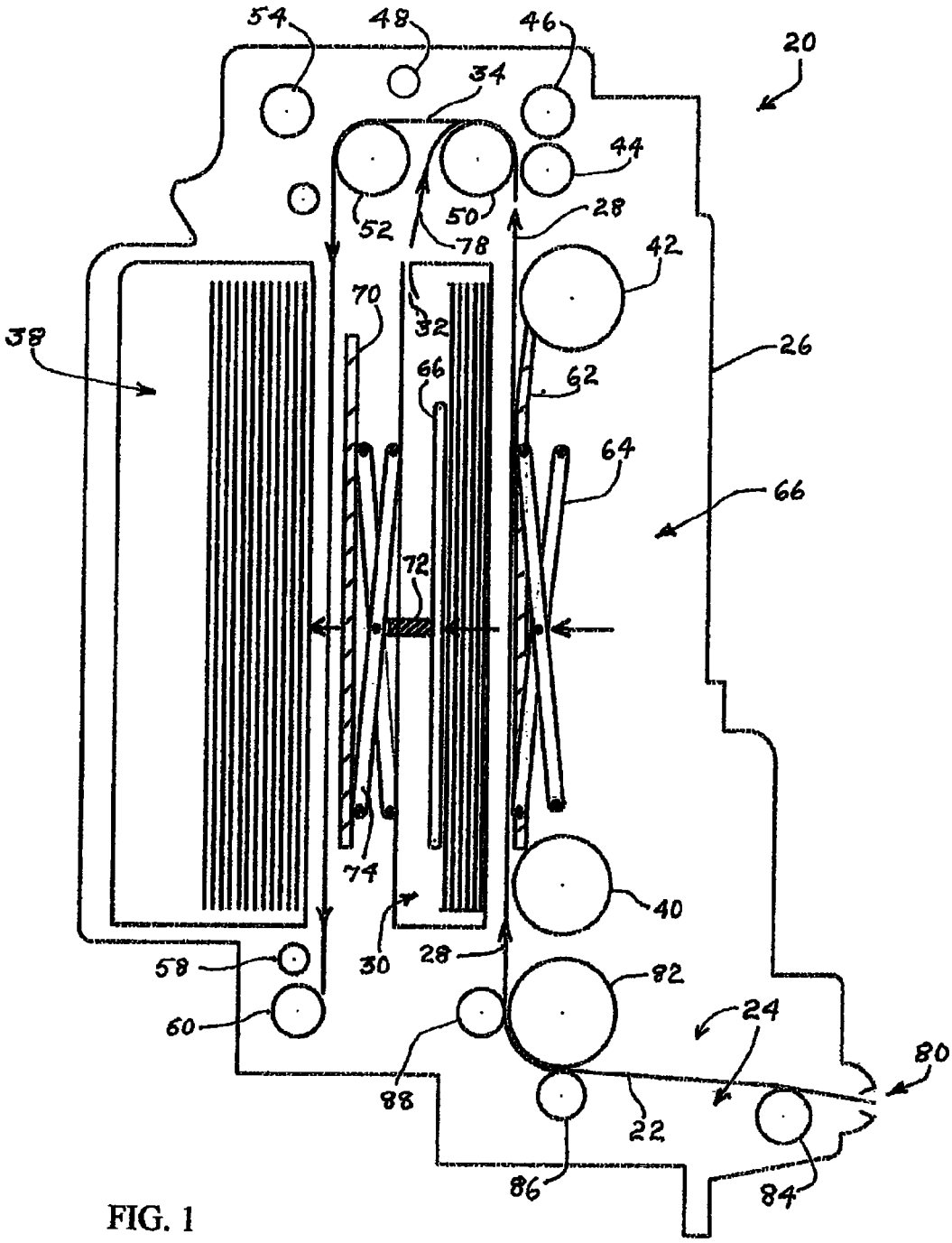
FIG. 1 is a simplified drawing of a sectional side view showing an embodiment of the bill receiving and payout device of the invention.

A simplified sectional side view drawing of the bill receiving and payout device 20 is shown in FIG. 1 having a bill validation passage 22 with its associated sensors and circuitry placed the general location 24 for the validation of inserted bills. Within the elongate portion 26 of the device 20, a validated bill is directed upward in a passage first direction 28 along the one side of a first bill receiving chamber 30 having a bill payback outlet 32. The passage first direction 28 is redirected around at path 34 and extends in the opposite passage second direction 36 along the rear side of the first bill receiving chamber 30. The second bill receiving chamber 38 extends along the outer side of the passage second direction 36 across from, and aligned with the first bill receiving chamber 30. The bill conveying apparatus for conveying a bill to the passage first or second directions 28 or 36 is accomplished by belts (not shown) moved along the passageways by pulleys 40 through 60 which support the left portion of the bills. A corresponding set of pulleys and belts (not shown and directly behind) are located to support the right portion of the said bills. The space between the left and right belt supported edges is sufficient to transfer bills out from the bill passage way 28 or 36 and into the first or second bill receiving chamber 30 or 38, respectively. A bill pushing member 62 (slightly less in width than the space between the bill supported edges in the passages) moves in a reciprocating motion across the passage first direction 28 to place a bill in the first bill receiving chamber 30 when the bill is positioned in front of the bill pushing member 62, and is controlled by the scissor mechanism 64 and driven by the motor/gear reciprocating device (not shown) in location 66. A bill is pushed in the second bill receiving chamber 38 when it is in a predetermined position in the passage second direction 36 by the bill pushing member 70 located at the rear of the first bill receiving chamber 30. The bill pushing member 70 is moved by the bill pushing member 62 pushing the stacked bills of the first bill receiving chamber 30 with its projection 72 pushing the scissor mechanism 74. This moves the pushing member 70 (which is slightly less in width than the unsupported central portion of the bill) to move the bill from the passage 36 and into the second receiving chamber 38.

Typically only the lowest denomination bills are stacked in the first receiving chamber 30 for bill payback. This is provided by removing a rearmost stacked bill 96 (shown in FIG. 4 in more detail) from the first bill receiving chamber 30 by moving it through the bill payback outlet 32 via the path 78 to the passages 34, 28 and the bill validation passage 22 by operating the bill conveying apparatus in the reverse direction to convey the bill out to the bill inlet 80 for customer payback.

The driving rollers 82 and 84 are geared together with the conveying apparatus of first and second passages 28 and 36 by pulley 40 to convey the bill while in the validation passage 22. The idler rollers 86 and 88 maintain a bill's contact with the driven pulley 82 when being moved between the passages 28 and 22. Idler roller 85 maintains a bill's contact with driving roller 84.

Figure 2:
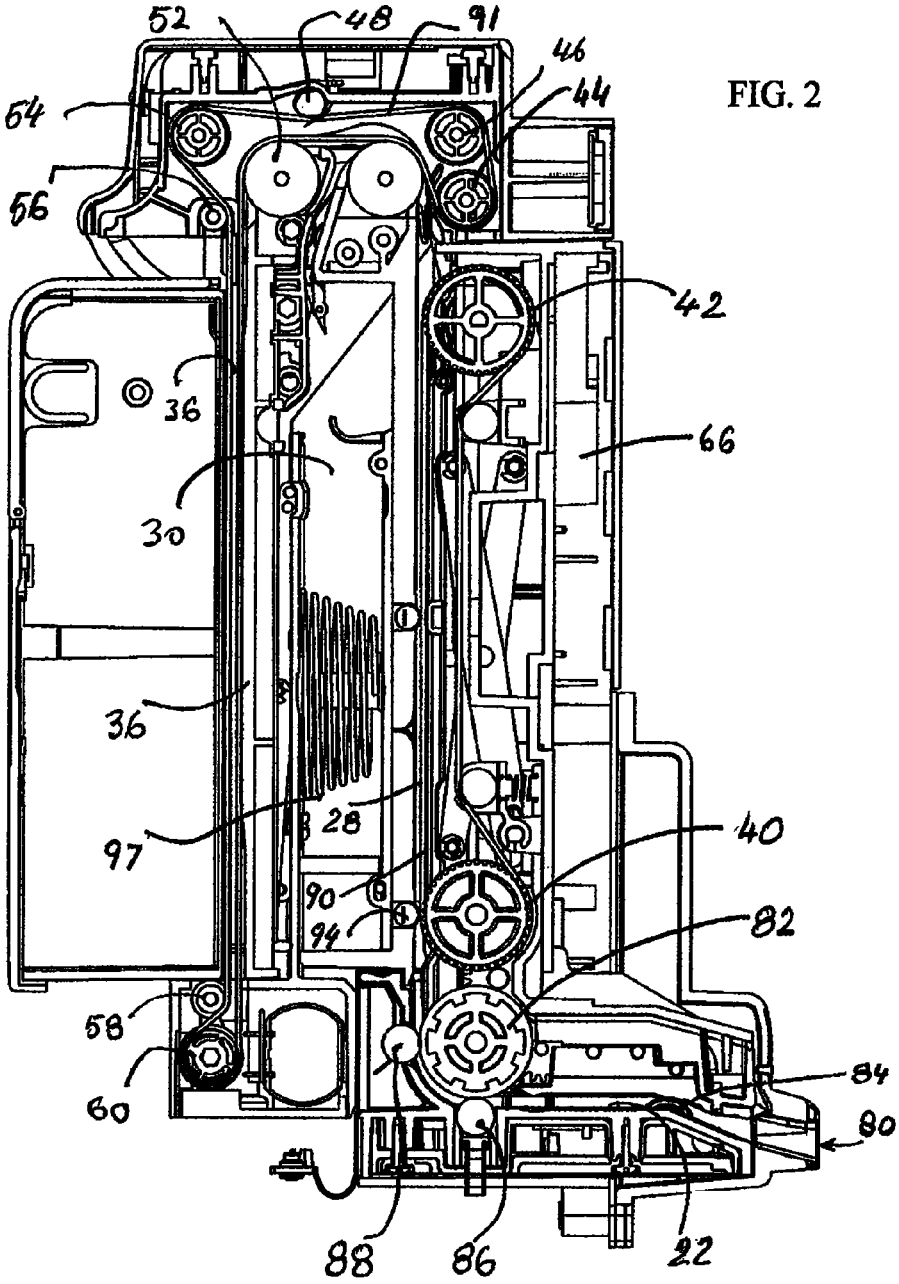
FIG. 2 is a sectional side view of the preferred embodiment showing the two bill receiving chambers and their associated pushing plates in their repose positions.

The cross sectional left side view of the preferred embodiment in FIG. 2 shows further details of the bill inlet 80, the conveying belt 90 with its pulleys 40 and 42, and pressure rollers 92 and 94. The conveyer belt 90 is directed around the pulleys and rollers 40, 42, 92, 94, to convey the bill along the passage first direction 28. The second conveyor belt 91 is positioned for the redirected passage 34 and the opposite passage second direction 36 controlled by pulleys and rollers 44 through 60. The pulleys 82 and 84 with pressure rollers 86 and 88 are geared with the driven pulley 40 to transport the bill between the bill inlet 80 (outlet) at the validation passage 22 and passage first direction 28. The belts, pulleys and rollers for conveying the bill's right edge is directly behind the ones shown herein for the left side. The bill pushing member 62 connected to the scissor mechanism 64 (shown in repose position) is driven by the motor/gear reciprocating device in location 66 to transfer a bill from the passage first direction 28 to the first bill receiving chamber 30. The press plate 95 is provided for pushing bills received in the bill receiving chamber 30 inwardly by the force of spring 97.

Figure 3:
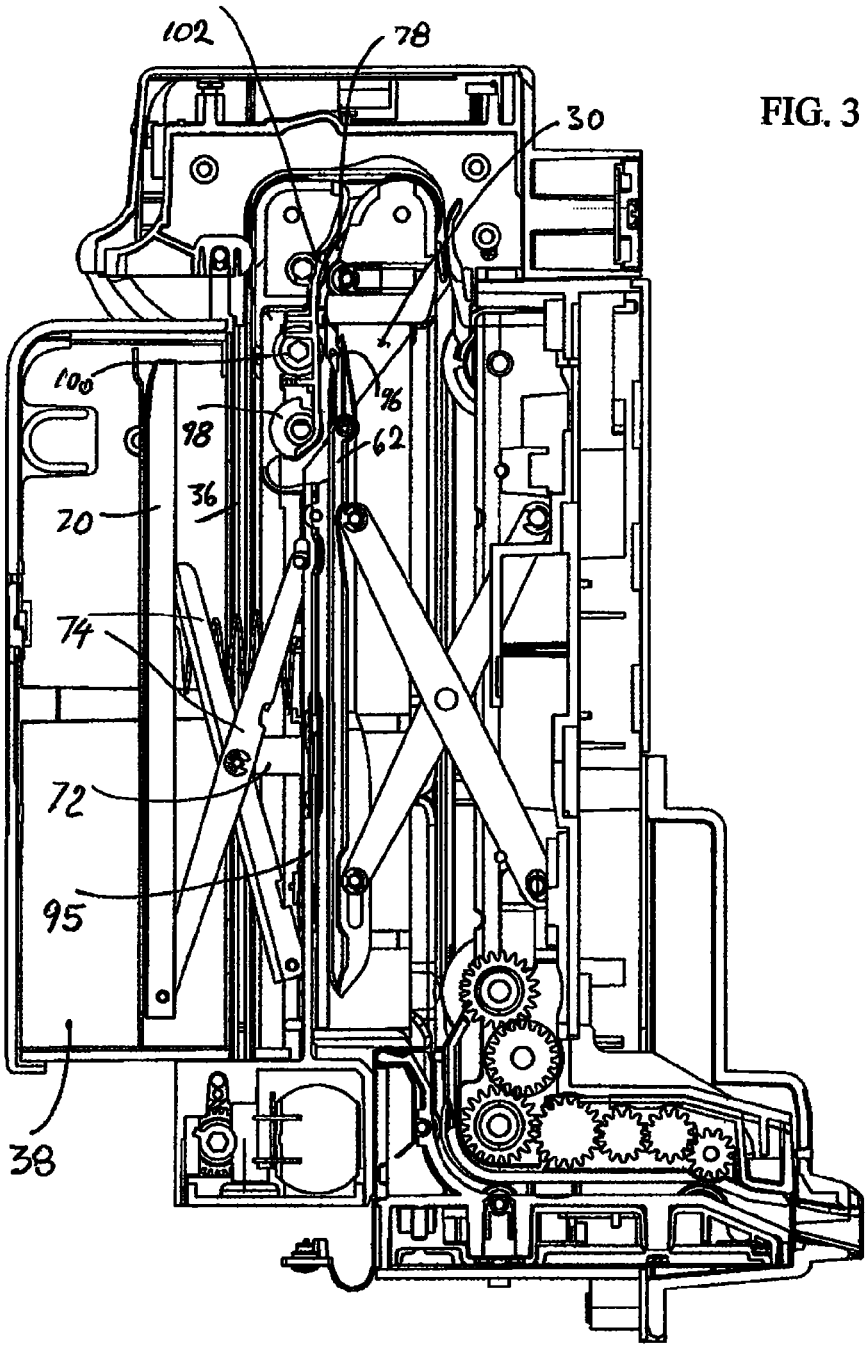
FIG. 3 is a sectional side view showing the two bill receiving chambers and their associated pushing plates in the extended positions.

In FIG. 3 the scissor mechanism 64 is shown in the extended position moving its bill pushing member 62 to transfer a bill 96 into the first bill receiving chamber 30 which also pushes the spring loaded press plate 95 with its projection 72 to operate the scissor mechanism 74 at the rear of the receiving chamber 30. This moves the pushing member 70 and will transfer a bill when it is conveyed to the passage 36 for transferring into the second receiving chamber 38. The rollers 98, 100 and 102 will extract the rearmost bill 96 to the path 78 as will be detailed next.

Figure 4:
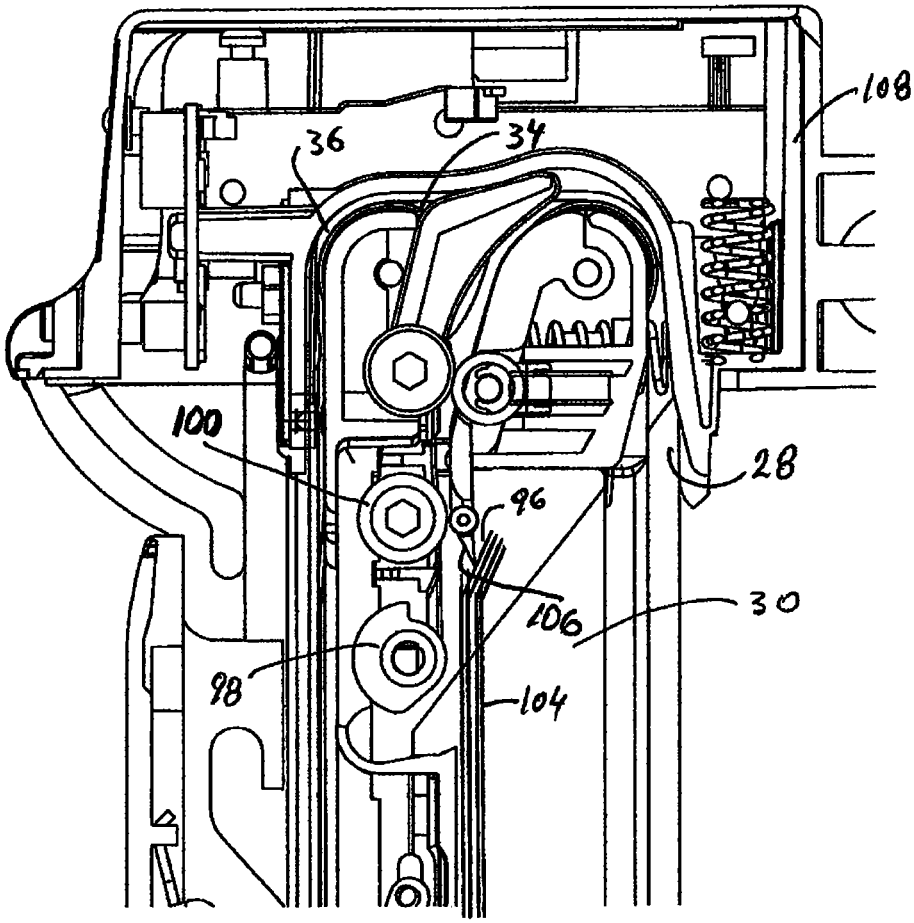
FIG. 4 is a sectional side view of the first bill receiving chamber when its rearmost bill is in its first state of payout.

FIG. 4 is a cross sectional left side view just past the left conveying belts showing the bill rollers for paying out bills from the first bill receiving chamber 30. The separation cam roller 98 is geared with driving rollers 100 and 102 and geared with the payout motor located at the location 108. During the first step for bill payback, the bill stack 104 is pushed against the upper bill retainer 106 by the pusher plate 62 (shown in FIG. 3) and places the rearmost bill 96 in close relationship to the separation cam roller 98 which has a contact surface which consists of a material of a large coefficient of friction such as rubber.

Figure 5:
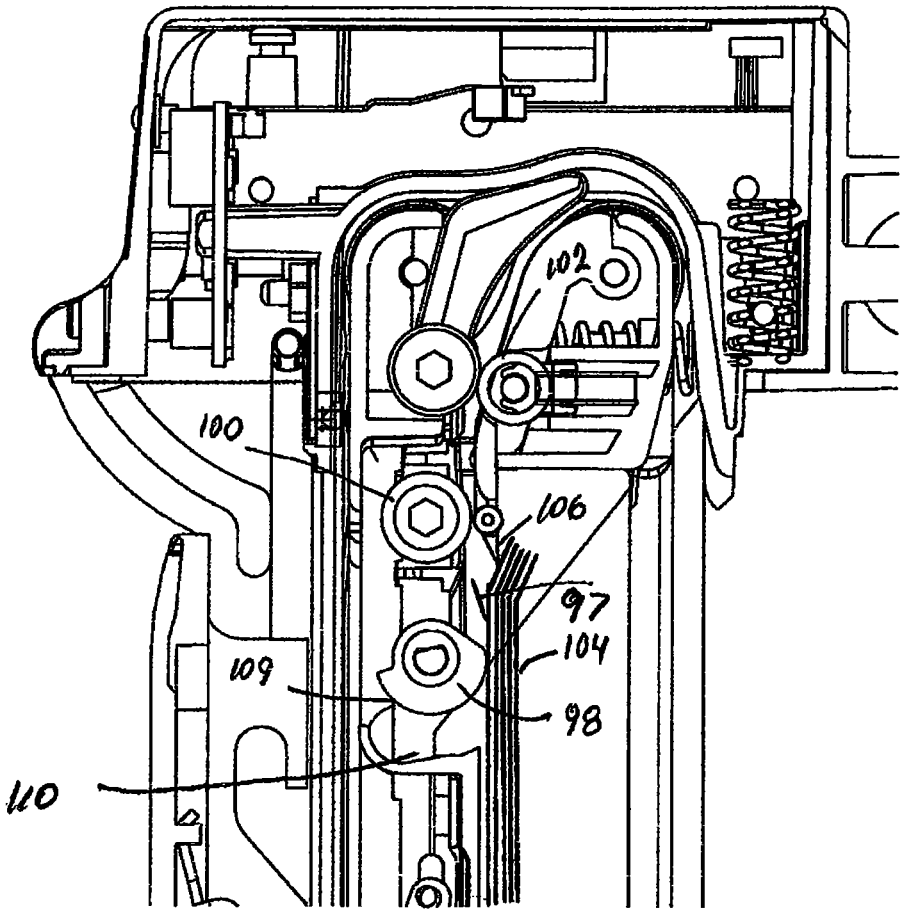
FIG. 5 is a sectional side view of the first bill receiving chamber when its rearmost bill is in its second state of payout.

In FIG. 5 the second step for bill payback occurs with the separation cam roller 98 rotating clockwise (together with rollers 100 and 102) to engage and retract the upper portion of the rearmost bill 96 from between the bill stack 104 and the upper bill retainer 106 until it extends around and below it to break a light beam coming from the emitting surface 109 and entering the sensor surface 110. This guarantees that the bill 96 edge 97 has been removed from between the upper bill retainer 106 and the bill stack 104.

Figure 6:
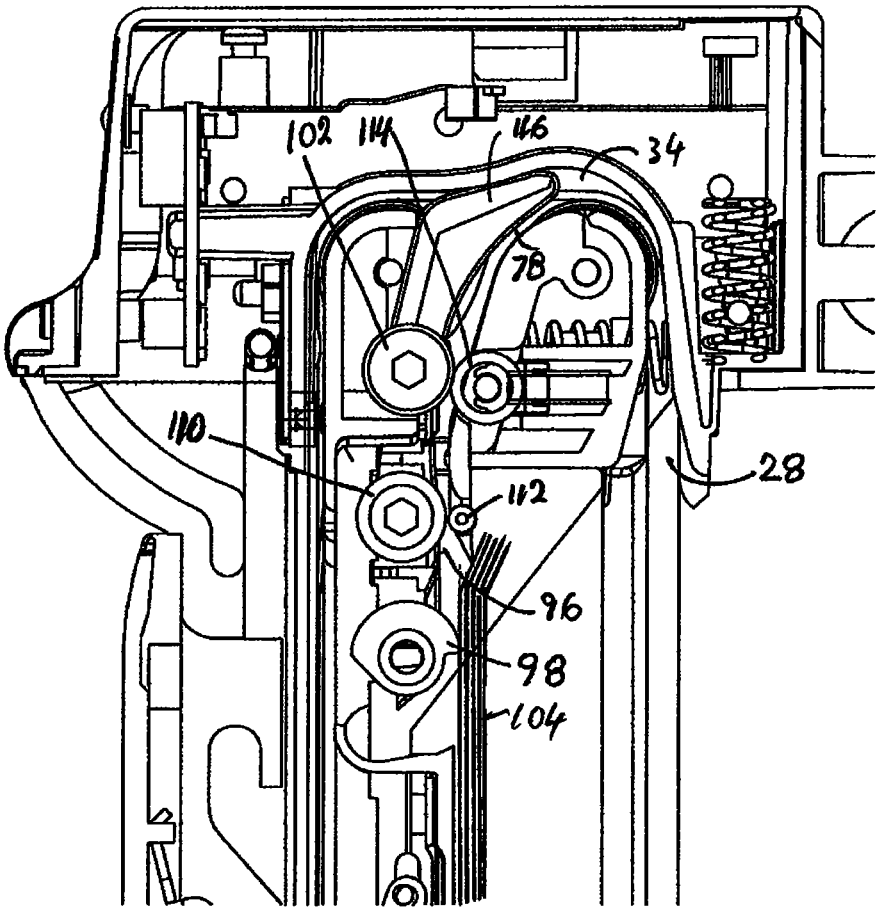
FIG. 6 is a sectional side view of the first bill receiving chamber when its rearmost bill is in its third state of payout.

In FIG. 6 the third step for bill back starts by rotating the separation cam roller 98 in the counterclockwise direction which moves the released upper edge of the bill 96 upward to enter between the roller 100 and its idler roller 112. The upper bill retainer 106 serves to guide the upper edge of the extracted bill 96 that then continues upwards to the drive roller 102 and its idler roller 114, and outwards through the passages 78, 34, 28 and into the validation passage 22 (shown in FIG. 2). The diverter gate 116 moves to open the path to the passage way 34 during payback by friction from the driving roller 102, and close it during the time that the bills are being directed to the bill receiving chamber 38 (shown in FIG. 3). The conveying belts are operated in the reverse direction during the three steps of bill payback until the bill 96 extends out from the bill entrance 80 (FIG. 2) sufficiently to be received by the customer yet retained to prevent accidental discharge.

Figure 7:
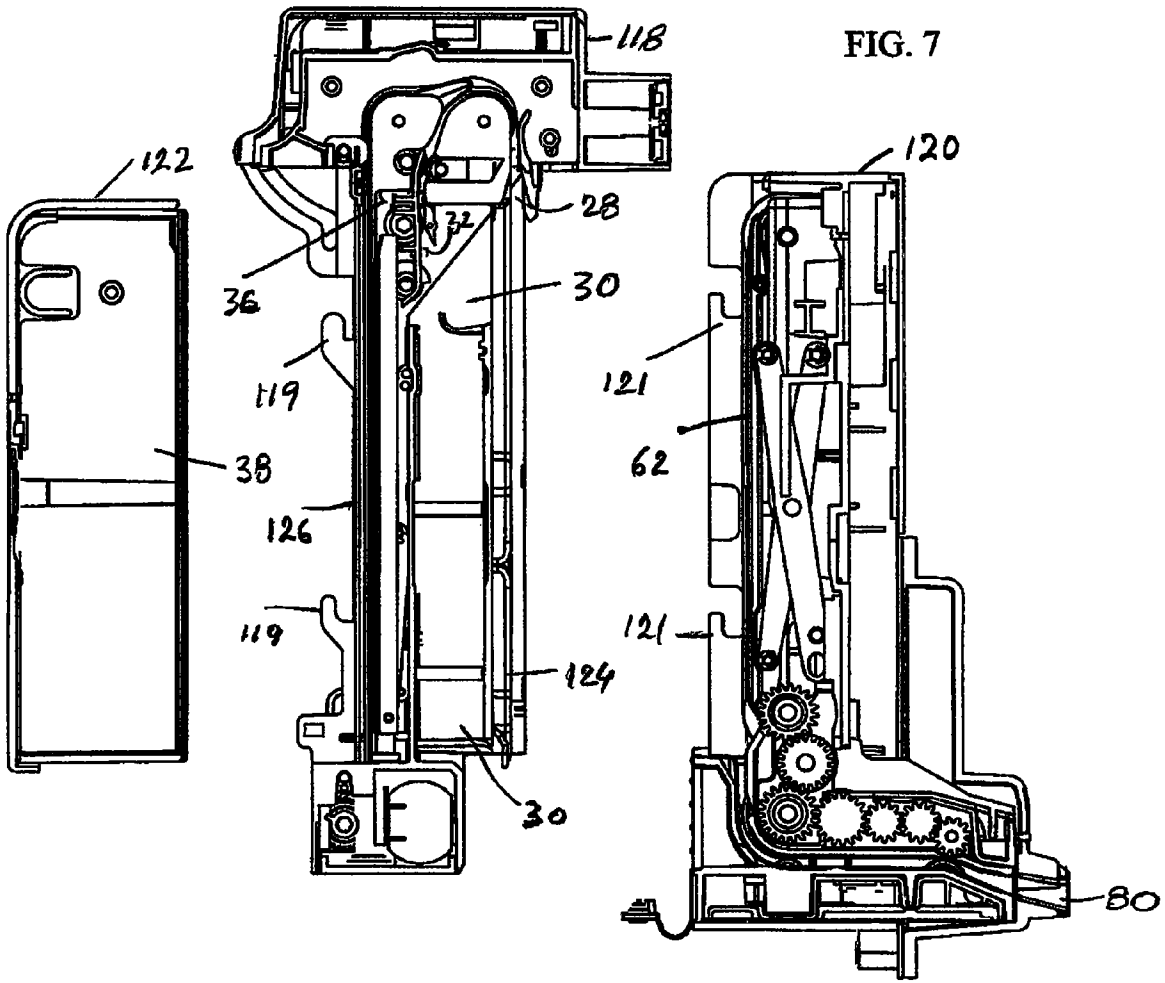
FIG. 7 is sectional side view of the preferred embodiment of the invention showing the three module portions unattached to show simplicity of convertibility.

FIG. 7 is a side view showing the modularity feature of the preferred embodiment with its center module 118 having the first bill receiving chamber 30, with the payback and conveying provisions. The bill validation and stacking module 120 consists of the bill entry 80, microprocessor, primary stacker plate 62, conveyor assembly, interconnection fingers 121 and other associated components. The left module 122 is the bill receiving chamber 38 with its spring biased bill plate and has simple means to be attached to the center module 118 attachment fingers 119. This feature provides for the conversion of the bill validator with bill payback to one without, by simply disconnecting the center module 118, and connecting only a bill receiving module like the left module 122. The right and left surfaces 124 and 126 of the center module 118 are at the passage first direction 28 along the one side of a first bill receiving chamber 30 having a bill payback outlet 32, and the opposite passage second direction 36 along the rear side of the first bill receiving chamber 30. When the center module 118 is not used, and the bill receiving module 38 is attached to the bill receiving and validation module 120, only the passage first direction 28 is reinstated with the primary stacker plate 62 stacking the bills directly into the bill receiving module 38. In this instance the bill receiving module may be of a larger expandable type.

Conversion from validating and stacking of bills only, to include the bill payback provision of module 118, is likewise made very easily.

Implementing Security Features:

The following describes a defense mechanism to deter theft due to fishing a bill Validator when power is removed from the unit.

The theft scenario could be described as follows. A customer modifies a valid bill with a loop made of material that is difficult to detect by the bill Validator and does not prevent validation of the bill. This bill is inserted and accepted by the bill Validator and the customer receives credit for the bill and ultimately change or product from the vending machine. The customer then removes power from the machine by pulling the AC power cord. While the machine and thus the unit are un-powered, the customer inserts a "hook" tool in the inlet, up to the cash box and hooks the loop on the previously inserted bill. This allows the customer to pull the bill out of the cash box and the bill inlet.

The operation for this improved level security is that while the unit is "idle", the primary stacker plate 62 is moved into a position that blocks the path to the cash box used to insert the hook tool but still allows the cash box to be removed while in this position. This prevents the customer from "fishing" an un-powered unit.

Figure 8:
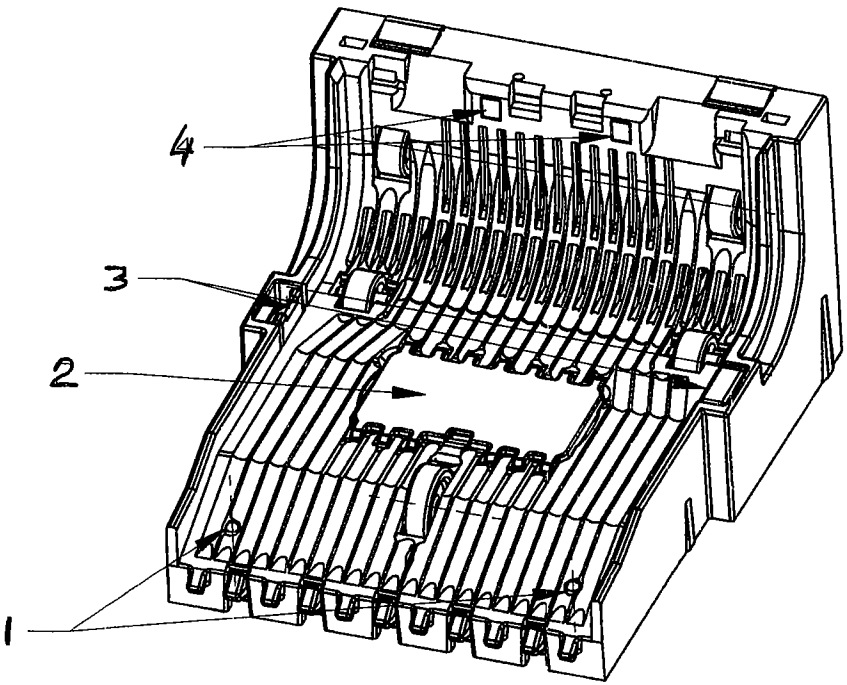
FIG. 8 is an isometric view of the lower section of the Validator inlet.

A Proffered Embodiment:

FIG. 8 is an isometric view of the lower section of the Validator inlet in the preferred embodiment of the invention showing the skew sensors 1, validation and position sensors 2, cross channel sensors 3, position rear clear sensors 4.

After receives power the Validator conducts a "power on" self test (POST) that cycles the primary stacker plate 62 to verify proper operation. This cycle returns the plate to the "home" position. The home position is defined as the position of the plate which allows a bill to transport through the unit without obstruction. In this position the plate is fully retracted into main housing 66.

Once POST has been completed, the primary stacker plate 62 will be moved forward a predetermined number of tachometer steps. The number of steps will be chosen with the assumption that the path 26 to the cash box is blocked and the cash box is capable of being removed. Because there is no sensor that allows the software to accurately locate this "blocking" position, the resting position of the plate for blocking purposes will vary depending on the unit and environmental conditions.

Under normal operations if the unit detects either of the skew sensors are broken it starts transporting the bill for data collection which places a significant amount of the bill is in the cash box. At the same time the primary stacker plate 62 will have to be retracted before the bill moves to the data collection process.

The primary stacker plate 62 remains retracted until the bill is returned or stacked. If the bill is returned, the primary stacker plate 62 will be placed in the blocking position by moving it forward the predetermined number of tachometer steps. If the bill is stacked, the primary stacker plate 62 is returned to home and then moved to the blocking position.

The following describes an improvement to the cross channel sensor used to protect the unit against bills with an attached string.

A Bill Validator device capable of detecting the presence of a string or other object attached to a bill with the intention of extracting the bill after it passes the bill Validator validation sensors and credit was given is known from the U.S. Pat. No. 6,441,891. The Bill Validator comprises a bill passageway having a first side and a second side, a light source positioned at the first side, the light source for emitting light across the passageway, a reflecting surface positioned at the second side, and a detector device positioned at the first side, the detector device for receiving light reflected from the reflecting surface.

The light source apparatus, the reflective surface and the detector portion, being so positioned relative to one another that a bill traveling through the passageway will obstruct the passage of light across the passageway and a trailing foreign object attached to the bill will obstruct at least some portion of the light being laterally transmitted and reflected across the passageway, whereby the continuing obstruction of at least a portion of the light after the bill has moved past said system is indicative of the presence of a trailing foreign object connected to a bill.

The cross channel sensor is susceptible to being blocked by water droplets condensing on the inlet housings of the Validator. In other conditions fine icing could occur and have a similar effect. This condensation causes a false position where the Validator reacts as thought it is being cheated and enters a defense state. In this state the primary stacker plate 62 is positioned in the cash box blocking the bill path. After a waiting period expires the primary stacker plate 62 is retracted and normal operation resumes. However, if the condensation still blocks the cross channel sensor the unit will immediately re-enter the defense state. The condensation literally places the unit out of service. The present method uses the dollar bill presented at the inlet to wick or displace the condensation in an attempt to put the unit back in service. The bill would be transported and moved back and forth in the unit.

Here is a Proffered Embodiment:

FIG. 8 is an isometric view of the lower section of the Validator inlet in the preferred embodiment of the invention showing the skew sensors 1, validation and position sensors 2, cross channel sensors 3, position rear clear sensors 4.

When the Validator is in the defense state and the primary stacker plate 62 is positioned in the stacker box, it will continue to monitor all the sensors that detect the bill position (skew sensors 1, locations sensors 4) and optical characteristics (validation sensors 2). The inlet LEDs will remain in operation such that the inlet is illuminated giving the appearance that the unit is enabled. When the skew sensors 1 are broken and the validation sensors 2 are unblocked, the Validator will start to transport the dollar bill forward into the unit. When the leading edge of the bill breaks the bill position sensors 2 the bill will be moved a predetermined number of tachometer steps then stopped. This number will place the leading edge of the bill past the cross channel sensor but not to the rear clear sensor.

The bill is then moved in reverse until the leading edge of the bill clears the position sensors 2.

This forward then backwards movement is repeated two more times for a total of six passes past the cross path sensor area. The bill is then returned. If after the bill is returned all the position sensors (skews 1, cross path 3, position 2 and rear clear 4) are un-broken, the plate is retracted and the unit resumes normal operation.

The forgoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by the details of the embodiments presented in this description. The above specification, examples provide a complete description of the manufacture and use of the invention. Many embodiments of the invention can be made without departing from the spirit and scope of the invention.

I claim:

1. A method of receiving and paying out bills comprising:

providing a bill passage in about the central portion of an elongate casing that extends in a first direction along one side of a first bill receiving chamber having a bill payback outlet, and redirected around and extending in an opposite second direction along the second side of said first bill receiving chamber;

providing a second bill receiving chamber extending along the outer side of the said passage second direction and across from and aligned with the said first bill receiving chamber;

providing a bill conveying apparatus for conveying a bill delivered to said bill passage first or second directions to a predetermined position for receiving it;

utilizing a bill pushing member for moving in a reciprocating motion across said passage in a first direction to said first bill receiving chamber when a validator is in an idle mode; and retracting the said bill pushing member that moves in a reciprocating motion across said passage first direction from said first bill receiving chamber to a main housing when the validator receives a signal from a skew sensor.

2. A method of receiving and paying out bills comprising:

providing a bill passage in about the central portion of an elongate casing that extends in a first direction along one side of a first bill receiving chamber having a bill payback outlet, and redirected around and extending in an opposite second direction along the second side of said first bill receiving chamber;

providing a second bill receiving chamber extending along the outer side of the said passage second direction and across from and aligned with the said first bill receiving chamber;

providing a bill conveying apparatus for conveying a bill delivered to said bill passage first or second directions to a predetermined position for receiving it;

utilizing a bill pushing member for moving in a reciprocating motion across said passage in a first direction to said first bill receiving chamber when a validator is in an idle mode;

retracting the said bill pushing member that moves in a reciprocating motion across said passage first direction from said first bill receiving chamber to a main housing when the validator receives signal from a skew sensor;

moving the incoming dollar bill forward and backward while supervising the signals from a cross channel sensor; and rejecting the bill and holding the pushing member in the first bill receiving chamber if either of the cross channel sensor or skew sensor are not clear.

* * * * *